US007389588B2

(12) United States Patent
Lau

(10) Patent No.: US 7,389,588 B2
(45) Date of Patent: Jun. 24, 2008

(54) SEMI-AUTOMATIC PENCIL SHARPENER

(76) Inventor: Tung Yan Lau, Room 406, Wah Yiu Ind. Ctr., 30-32 Au Pui Wan St., Fotan, N.T., Hong Kong (CN)

( * ) Notice: Subject to any disclaimer, the term of this patent is extended or adjusted under 35 U.S.C. 154(b) by 205 days.

(21) Appl. No.: 11/305,028

(22) Filed: Dec. 19, 2005

(65) Prior Publication Data

US 2007/0068013 A1 Mar. 29, 2007

(30) Foreign Application Priority Data

Sep. 29, 2005 (CN) ..... 2005 2 0127053 U

(51) Int. Cl.
*B43L 23/02* (2006.01)

(52) U.S. Cl. ..... 30/454; 144/28.11

(58) Field of Classification Search ..... 30/451, 30/453, 454, 457, 458, 459; 144/28.1, 28.11, 144/28.2, 28.3, 28.4, 28.6, 28.8, 28.9
See application file for complete search history.

(56) References Cited

U.S. PATENT DOCUMENTS 2,188,130 A * 1/1940 Baier et al. ..... 30/454
2,439,252 A * 4/1948 Jordan ..... 144/28.11
2,769,428 A * 11/1956 Onanian ..... 144/28.4
2,995,112 A * 8/1961 Calhoun ..... 144/28.71
3,561,507 A * 2/1971 Dziuk ..... 144/28.4
4,755,074 A * 7/1988 Roberts ..... 401/52
5,394,613 A * 3/1995 Ku ..... 30/454

* cited by examiner

*Primary Examiner*—Hwei-Siu C. Payer

(57) ABSTRACT

The present invention relates to a semi-automatic pencil sharpener comprising a sharpening body and a blade; the sharpening body has a conical bore with a throughslot for allowing shavings to go out; and the blade is disposed outside the sharpening body on one side of the shavings throughslot; an external housing is disposed outside the sharpening body; the external housing comprises a pencil fixation casing and a rotation casing which can rotate opposite to each other; the pencil fixation casing and the rotation casing are removably engaged with each other. The present pencil sharpener can be operated with one hand. It is convenient to use in comparison with available products and has a high degree of automation. Pencil shavings produced from pencil sharpening using the present invention can be stored in the pencil sharpener without falling out affecting hygiene. The present invention is therefore relatively easy to clean up and is environmental friendly. It also has the advantages of being small in size, easy to carry around and good for application.

4 Claims, 3 Drawing Sheets

SEMI-AUTOMATIC PENCIL SHARPENER

BACKGROUND OF THE INVENTION

The present invention relates to stationery and more particularly pertains to a semi-automatic pencil sharpener in the field of implements for writing or drawing.

The pencil sharpeners available in the marketplace are relatively simple in construction. They mainly comprise a sharpening body which has a conical bore with a throughslot for allowing shavings to go out, and onto which a blade is connected. To operate, the user inserts a pencil into the conical bore and makes the pencil to rotate opposite to the sharpening body, thereby making the blade to sharpen the pencil. This kind of pencil sharpeners is convenient to use, but has a relatively low degree of automation. Further, in the sharpening process pencil shavings easily drop and it is not easy to clean up.

BRIEF SUMMARY OF THE INVENTION

In view of the aforesaid disadvantages now present in the prior art, the object of the present invention is to provide a semi-automatic pencil sharpener which has the advantages of being compact in construction, convenient to use, easy to clean up pencil shavings and having a relatively high degree of automation.

To attain this, the present invention generally comprises a sharpening body and a blade; the sharpening body has a conical bore with a through slot for allowing shavings to go out; and the blade is disposed outside the sharpening body on one side of the shavings through slot; wherein an external housing is disposed outside the sharpening body; the external housing comprises a pencil fixation casing and a rotation casing which can rotate relative to the pencil fixation casing; the pencil fixation casing and the rotation casing are rotatably engaged with each other.

The pencil fixation casing comprises an external casing, a rubberized fixing sleeve and an inner casing; the inner casing is securely engaged with the external casing and the rubberized fixing sleeve; one end of the external casing has an opening; the rubberized fixing sleeve is inserted into the opening; the center of the rubberized fixing sleeve has a throughhole and the diameter of the throughhole is smaller than the diameter of a pencil, and a pencil can be inserted into the throughhole and is thus fixed in position tightly.

One end of the rotation casing is in cylindrical shape, which can be inserted into the external casing and coupled with the external casing, and the rotation casing can rotate relative to the external casing.

The other end of the rotation casing is in the shape of an axially symmetrical wheel, one side thereof is a smooth arc-shaped curved surface which is made of rubber, and the friction coefficient of its surface is relatively high.

A spring is disposed within the external casing in such a way to abut against an upper end of the rotation casing at one end and the bottom end of the inner casing at another end; the sharpening body with a blade connected thereon is disposed inside the other end of the rotation casing which is in the shape of an axially symmetrical wheel; the sharpening body and the spring are connected together with a lining in between.

The end of the rotation casing which is in the shape of an axially symmetrical wheel comprises a connector and an arc-shaped base which are connected to each other by engaging the respective recesses and projections thereon. The object of such construction is to allow users to conveniently open the base and dispose of the pencil shavings.

To use the present pencil sharpener, the user inserts a pencil into the rubberized fixing sleeve of the pencil fixation casing until it reaches the conical bore of the sharpening body. The rubberized fixing sleeve will then tightly fix the position of the pencil so that the pencil and the present pencil sharpener become an integral structure. Then, the user pulls the external casing outwards, and as a result the rubberized fixing sleeve is pulled outwards along the pencil and the inner casing is also pulled outwards, and the spring comes to a compressed state. The spring is prevented from returning to its original state by the friction between the inner surface of the rubberized fixing sleeve and the outer surface of the pencil. The user then holds the pencil in a manner that the end which is in the shape of an axially symmetrical wheel of the present pencil sharpener contacts a plane and it moves parallel to the plane. Since the pencil and the pencil fixation casing of the present pencil sharpener are relatively static and do not rotate, while the rotation casing of the present pencil sharpener rotates relative to the pencil fixation casing due to the effect of planar friction, and since the sharpening body in the rotation casing and the rotation casing are relatively static, the sharpening body rotates relative to the pencil fixation casing, the sharpening body therefore rotates opposite to the pencil, the pencil is thus sharpened by the blade of the sharpening body. Following the rotation of the pencil sharpener, the spring gradually releases with the rotation of the rotation casing relative to the pencil fixing casing and pushes the bottom end of the inner casing to its original position, thereby continues to bring the pencil deeper into the rotation casing. The pencil is gradually pared and sharpened and pencil shavings produced are stored in the rotation casing. When the spring fully returns to its original position, the user may pull out the pencil. If the pencil is not sharp enough, the above steps can be repeated.

The present invention, in comparison with known arts, has the following advantages and effects:

First, since the present pencil sharpener can be operated with one hand, it is more convenient to use and has a higher degree of automation.

Secondly, pencil shavings produced from pencil sharpening using the present pencil sharpener can be stored in the pencil sharpener without falling out affecting hygiene. The present invention is therefore relatively easy to clean up and is environmental friendly.

Further, the main components (sharpening body, blade and spring) of the present pencil sharpener are encased within the external housing which effectively avoids them from being damaged due to external forces (such as being dropped onto the floor). Since the blade is not directly exposed on the external surface, the present pencil sharpener more effectively avoids users (especially children) from being cut.

The present pencil sharpener also has the advantages of being compact in construction, small in size, easy to carry around and good for application.

DETAILED DESCRIPTION OF THE INVENTION

Figure 1:
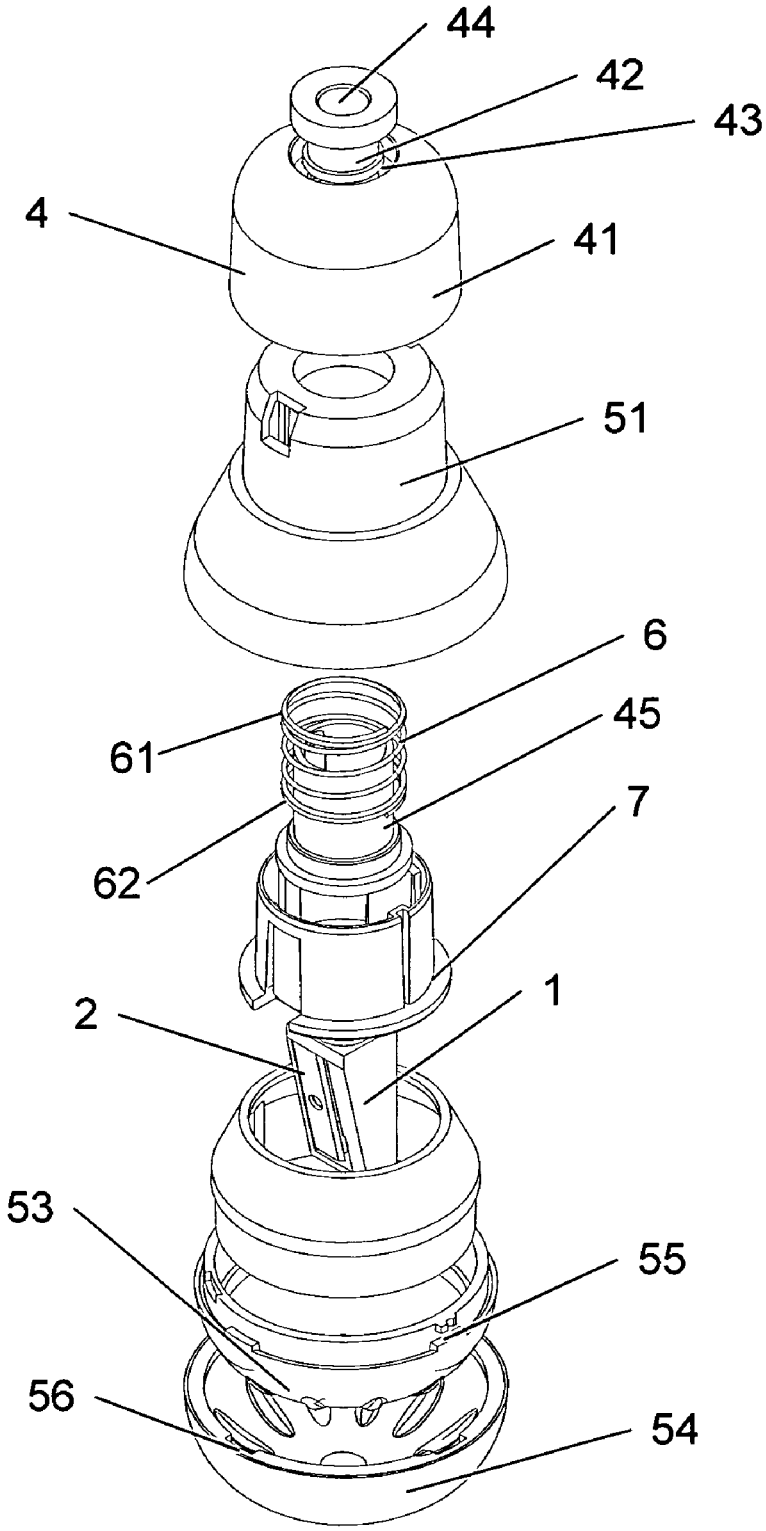
FIG. 1 shows the construction of a pencil sharpener of the present invention.
Figure 2:
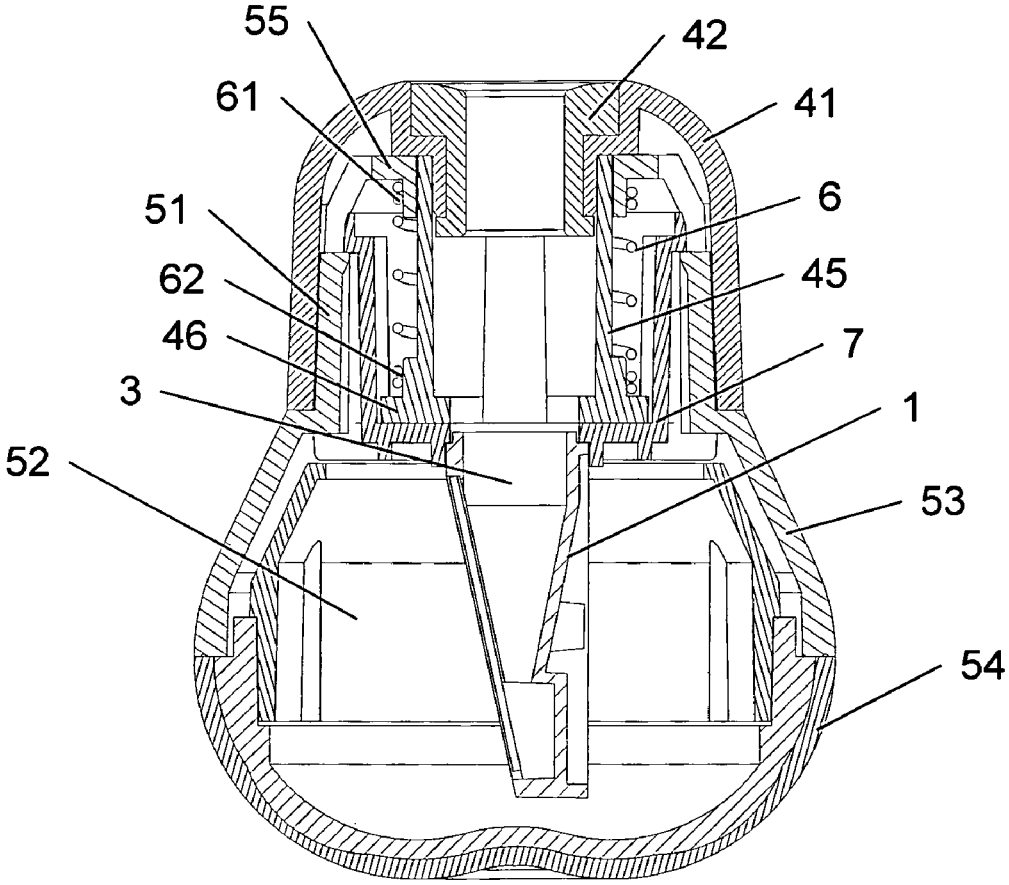
FIG. 2 shows the cross-sectional view of the pencil sharpener of FIG. 1.

The present invention is further described in detail with the following embodiment and the accompanying drawings. FIGS. 1 and 2 show the construction of the present invention. As illustrated in FIGS. 1 and 2, the present invention generally comprises a sharpening body 1 and a blade 2; the sharpening body 1 has a conical bore 3 with through slot for allowing shavings to go out; and the blade 2 is disposed outside the sharpening body 1 on one side of the shavings through slot; an external housing is disposed outside the sharpening body 1; the external housing comprises a pencil fixation casing 4 and a rotation casing 5 which can rotate relative to the pencil fixation casing 4; the pencil fixation casing 4 and the rotation casing 5 are rotatably engaged with each other. The pencil fixation casing 4 comprises an external casing 41, a rubberized fixing sleeve 42 and an inner casing 45; the inner casing 45 is securely engaged with the external casing 41 and the rubberized fixing sleeve 42; one end of the external casing 41 has an opening 43; the rubberized fixing sleeve 42 is inserted into the opening 43; the center of the rubberized fixing sleeve 42 has a throughhole 44 and the diameter of the throughhole 44 is smaller than the diameter of a pencil, and a pencil can be inserted into the throughhole 44 and is thus fixed in position tightly. One end 51 of the rotation casing 5 is in cylindrical shape, which can be inserted into the external casing 41 and coupled with the external casing 41, and the rotation casing 5 can rotate relative to the external casing 41. The other end 52 of the rotation casing 5 is in the shape of an axially symmetrical wheel, one side thereof is a smooth arc-shaped curved surface, which is made of rubber, and the friction coefficient of its surface is relatively high. As illustrated in FIG. 2, a spring 6 is disposed within the external casing 41 in such a way to abut against the upper end 55 of the rotation casing 5 at one end 61 and the bottom end 46 of the inner casing 45 at the other end 62; the sharpening body 1 with the blade 2 connected thereon is disposed inside the other end 52 of the rotation casing 5 which is in the shape of an axially symmetrical wheel; the sharpening body 1 and the spring 6 are connected together with a lining 7 in between. The other end 52 of the rotation casing 5 which is in the shape of an axially symmetrical wheel comprises a connector 53 and an arc-shaped base 54. Axially symmetrical projections 55 are disposed on the external wall of the connector 53 and axially symmetrical recesses 56 are disposed on the internal wall of the arc-shaped base 54; the connector 53 and the arc-shaped base 54 are connected to each other by engaging the respective projections 55 and recesses 56. This construction allows users to conveniently open the base and dispose of the pencil shavings.

Figure 3:
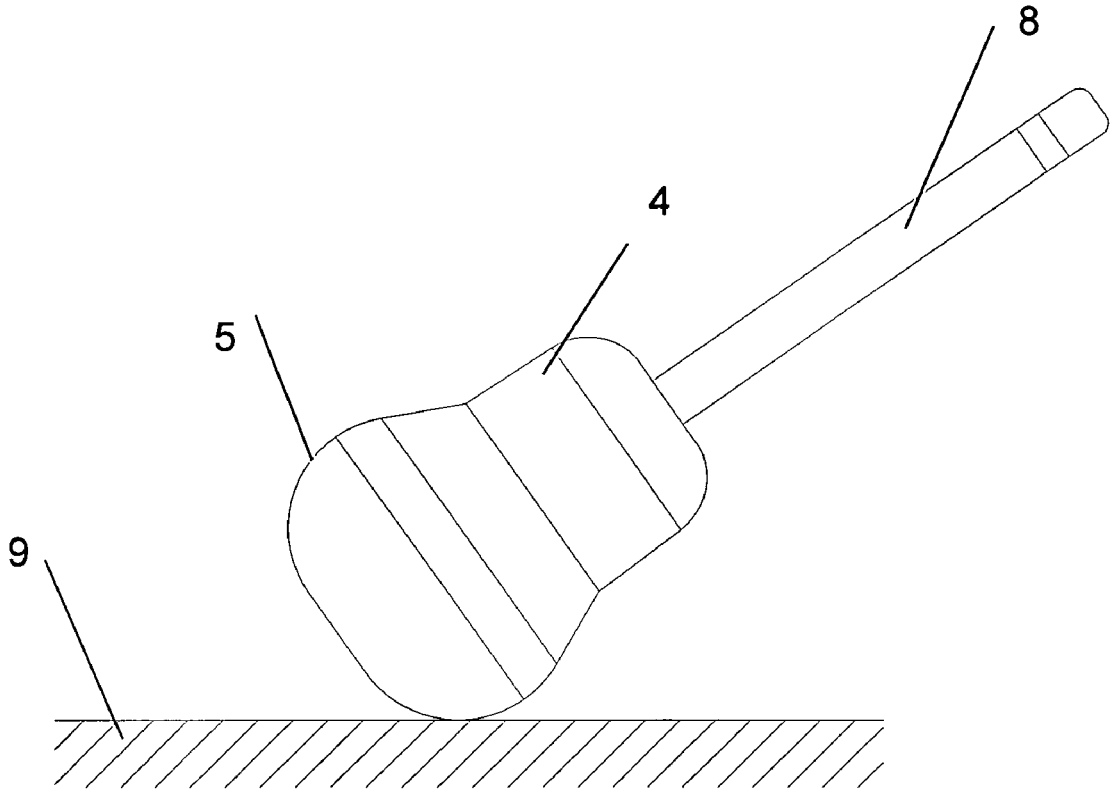
FIG. 3 shows the pencil sharpener of FIG. 2 when it is in use.

To use the present pencil sharpener, the user inserts a pencil 8 into the rubberized fixing sleeve 42 of the pencil fixation casing 4 until it reaches the conical bore 3 of the sharpening body 1. The rubberized fixing sleeve 42 will then tightly fix the position of the pencil 8 so that the pencil 8 and the present pencil sharpener become an integral structure. Then, the user pulls the external casing 41 outwards, and as a result the rubberized fixing sleeve 42 is pulled outwards along the pencil 8 and the inner casing 45 is also pulled outwards. As the bottom end 46 of the inner casing 45 is being pulled outwards, and the spring 6 comes to a compressed state. The spring 6 is prevented from returning to its original state by the friction between the inner surface of the rubberized fixing sleeve 42 and the outer surface of the pencil 8. The user then holds the pencil 8 in a manner that the end 52 which is in the shape of an axially symmetrical wheel of the present pencil sharpener contacts a plane 9 and moves parallel to the plane 9 as illustrated in FIG. 3. Since the pencil 8 and the pencil fixation casing 4 of the present pencil sharpener are relatively static and do not rotate, while the rotation casing 5 of the present pencil sharpener rotates relative to the pencil fixation casing 4 due to the effect of planar friction, and since the sharpening body 1 in the rotation casing 5 and the rotation casing 5 are relatively static, the sharpening body 1 rotates relative to the pencil fixation casing 4, the sharpening body 1 therefore rotates relative to the pencil 8, the pencil 8 is then sharpened by the blade 2 of the sharpening body. Following the rotation of the pencil sharpener, the spring 6 gradually releases with the rotation of the rotation casing 5 relative to the pencil fixation casing 4 and pushes the bottom end 46 of the inner casing 45 to its original position, thereby continues to bring the pencil 8 deeper into the rotation casing 5. The pencil 8 is gradually pared and sharpened and pencil shavings produced are stored in the rotation casing 5. When the spring 6 fully returns to its original position, the user may pull out the pencil 8. If the pencil 8 is not sharp enough, the above steps can be repeated.

The above embodiment is a preferred embodiment of the present invention. The present invention is capable of other embodiments and is not limited by the above embodiment. Any other variation, decoration, substitution, combination or simplification, whether in substance or in principle, not deviated from the spirit of the present invention, is replacement or substitution of equivalent effect and falls within the scope of protection of the present invention.

What is claimed is:

1. A semi-automatic pencil sharpener comprising a sharpening body and a blade; the sharpening body has a conical bore with a through slot for allowing shavings to go out; and the blade is disposed outside the sharpening body on one side of the shavings through slot; wherein an external housing is disposed outside the sharpening body; the external housing comprises a pencil fixation casing and a rotation casing which can rotate relative to the pencil fixation casing; the pencil fixation casing and the rotation casing are rotatably engaged with each other; the pencil fixation casing comprises an external casing, a rubberized fixing sleeve and an inner casing; the inner casing is securely engaged with the external casing and the rubberized fixing sleeve; one end of the external casing has an opening; the rubberized fixing sleeve is inserted into the opening; the center of the rubberized fixing sleeve has a throughhole and the diameter of the throughhole is smaller than the diameter of a pencil.

2. The semi-automatic pencil sharpener as in claim 1, wherein one end of the rotation casing is in cylindrical shape, which can be inserted into the external casing and coupled with the external casing, and the rotation casing can rotate relative to the external; the other end of the rotation casing is in the shape of an axially symmetrical wheel, one side thereof is a smooth arc-shaped curved surface.

3. The semi-automatic pencil sharpener as in claim 2, wherein a spring is disposed within the external casing in such a way to abut against an upper end of the rotation casing at one end and a bottom end of the inner casing at another end; the sharpening body is disposed inside the other end of the rotation casing which is in the shape of an axially symmetrical wheel; the sharpening body and the spring are connected together with a lining in between.

4. The semi-automatic pencil sharpener as in claim 2, wherein the other end of the rotation casing which is in the shape of an axially symmetrical wheel comprises a connector and an arc-shaped base which are connected to each other by engaging respective recesses and projections.

* * * * *